US012623131B2

(12) United States Patent
Pery

(10) Patent No.: US 12,623,131 B2
(45) Date of Patent: May 12, 2026

(54) CLIMBING WALL

(71) Applicant: RECLIMB Prosta Spółka Akcyjna, Lublin (PL)

(72) Inventor: Marcin Pery, Warsaw (PL)

(73) Assignee: RECLIMB Prosta Spółka Akcyjna, Lublin (PL)

( * ) Notice: Subject to any disclaimer, the term of this patent is extended or adjusted under 35 U.S.C. 154(b) by 79 days.

(21) Appl. No.: 18/420,907

(22) Filed: Jan. 24, 2024

(65) Prior Publication Data

US 2024/0157212 A1 May 16, 2024

Related U.S. Application Data

(63) Continuation of application No. PCT/EP2022/051892, filed on Jan. 27, 2022.

(30) Foreign Application Priority Data

Jul. 26, 2021 (EP) ..... 21187640

(51) Int. Cl.
*A63B 69/00* (2006.01)

(52) U.S. Cl.
CPC ..... *A63B 69/0048* (2013.01)

(58) Field of Classification Search
CPC ..... A63B 69/0048; A63B 71/0036; A63B 71/0622; A63B 2209/08; A63B 2225/09; A63B 2225/20; B25J 11/003; B25J 1/08
See application file for complete search history.

(56) References Cited

U.S. PATENT DOCUMENTS

2019/0381359 A1 12/2019 Polig

FOREIGN PATENT DOCUMENTS

| | | | | | |
|---|---|---|---|---|---|
| CN | 114849197 | A | * | 8/2022 | |
| EP | 2420304 | A1 | | 2/2012 | |
| EP | 3821959 | A1 | | 5/2021 | |
| WO | WO-2010119159 | A1 | * | 10/2010 | ..... A63B 69/0048 |

OTHER PUBLICATIONS

European Patent Office, European Search Report in European Patent Application No. 21187640.4, 2 pp. (Dec. 16, 2021).
European Patent Office, International Search Report in International Patent Application No. PCT/EP2022/051892, 5 pp. (May 12, 2022).
European Patent Office, Written Opinion in International Patent Application No. PCT/EP2022/051892, 6 pp. (May 12, 2022).
IKEA, IKEA Katalog 2008—Lekman Box, product catalog downloaded from the Internet at http://www.produkte24.com/images/catalogs/77/pdf_12693.pdf on Jul. 22, 2019, 4 pp. (2008).

* cited by examiner

*Primary Examiner* — Megan Anderson
*Assistant Examiner* — Jacqueline N L Loberiza
(74) *Attorney, Agent, or Firm* — Leydig, Voit & Mayer, Ltd.

(57) ABSTRACT

A climbing wall includes a climbing wall module defining spatial compartments into which bodies of climbing holds are selectively placed to define a front surface of the climbing wall module, which can be adjusted to the movements of the users of the climbing wall. Behind the climbing wall module is a climbing holds storage module. At least one robot manipulates the bodies of the climbing holds placed in the climbing wall module and/or the climbing holds storage module.

18 Claims, 8 Drawing Sheets

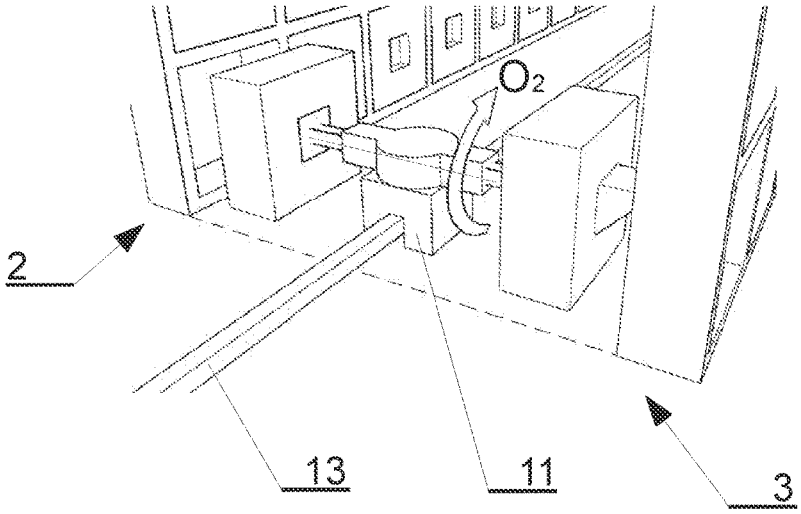
Fig. 15
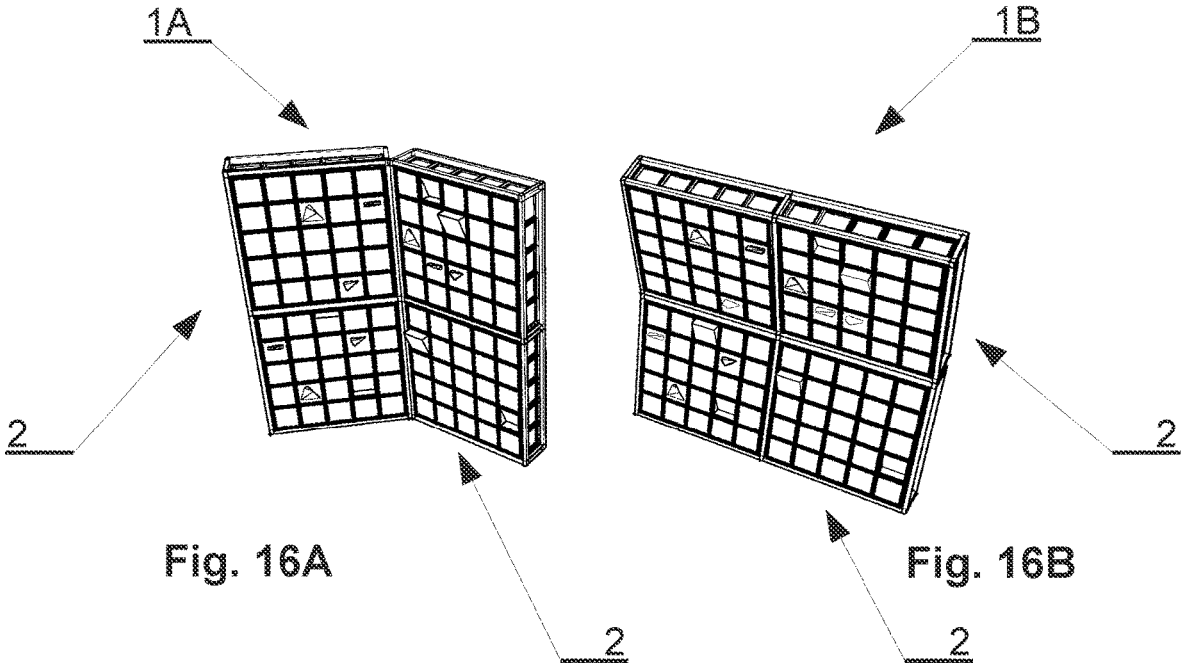
Fig. 16A
Fig. 16B

CLIMBING WALL

CROSS-REFERENCE TO RELATED APPLICATIONS

The instant application claims priority to International Patent Application No. PCT/EP2022/051892, filed Jan. 27, 2022, which is incorporated herein in its entirety by reference.

FIELD OF THE DISCLOSURE

The instant application generally relates to exercise equipment and, more particularly, to a climbing wall.

BACKGROUND OF THE INVENTION

In prior art, from DE202005009100U1 there is a known spatial climbing construction having a supporting frame with open and closed compartments. The supporting frame is made of vertical and horizontal brackets forming the shape of a cuboid. The crossed brackets of the supporting construction form compartments, in which fillings in the form of a plate can be mounted, forming an arrangement of passages across the supporting construction similar to a maze with branching and crossroads. Therefore, this type of fillings closes the selected compartments of the supporting construction. The consecutive fillings mounted in the supporting construction have a functional nature and they comprise additional elements, such as climbing holds, ladders, steps or slides. The fillings with mounted climbing holds allow for creating a climbing segment in the supporting construction, wherein the climbing holds can also be placed in other parts of the climbing construction. The supporting constructions can be combined with each other, forming larger units with various outer shapes.

EP2420304A1 in turn discloses a modular climbing wall, having a supporting construction with an arrangement of vertical and horizontal partitions. The partitions define sets of compartments, in which the bodies of climbing holds are detachably mounted. The compartments can have any inner shape formed by the connected partitions, the outer shape of the bodies of the climbing holds has to be adjusted to the inner shape of the compartments. In particular, they are cubic compartments, having the mounted bodies of the climbing holds with a cubic shape. The outer shape of the body of the climbing hold itself corresponds to the shape of the compartment, and it has proper climbing holds mounted thereto. The body with the proper climbing hold forms a module mounted in the compartment of the climbing wall. Detachably mounting in the compartment is realised by means of a bolt or locking elements placed on the front part of the climbing wall, at the point of intersection of the partitions. In particular, the locking elements can have the form of a cross, mounted at the intersection of the partitions. Therefore, the locking element in a neutral position lies entirely in the plane of the partitions. On the other hand, after a change in its position, the arms lock four compartments with the climbing holds. The compartments of the climbing wall are filled with modular climbing holds. The arranging of the climbing routes is simple, since the position of the bodies of the climbing holds between the compartments in the climbing wall can be changed arbitrarily, or by changing the position of the body of the climbing hold in the compartment, therefore forming climbing routes with a varying level of difficulty.

BRIEF SUMMARY OF THE INVENTION

The present disclosure describes systems and methods for improving and expediting the exchange of climbing holds in order to arrange climbing routes.

In one embodiment, the disclosure describes a climbing wall, comprising at least one climbing wall module having a supporting construction with an arrangement of partitions defining spatial compartments with multiple bodies of climbing holds placed therein, in which one can distinguish a front and a back wall, as well as side walls, the front walls of the bodies of the climbing holds along with the supporting construction forming the front surface of the climbing wall module, adjusted to the movements of the users of the climbing wall.

In one embodiment, at least one climbing wall module includes at least one climbing holds storage module at a distance therefrom, having a supporting construction with an arrangement of partitions defining spatial compartments adjusted to receive the body of the climbing hold, and in the space between the climbing wall module and the climbing holds storage module there is at least one robot adjusted to manipulate the multi-walled bodies of the climbing holds placed in the climbing wall module and/or the climbing holds storage module.

BRIEF DESCRIPTION OF THE SEVERAL VIEWS OF THE DRAWING(S)

FIGS. 11, 12, 13, 14, and 15 illustrate outline views of various operating positions of a Cartesian coordinate robot in the working space in perspective views in accordance with the disclosures.

FIGS. 16A and 16B are outline views in two different configurations in accordance with the disclosure.

DETAILED DESCRIPTION OF THE INVENTION

Figure 1:
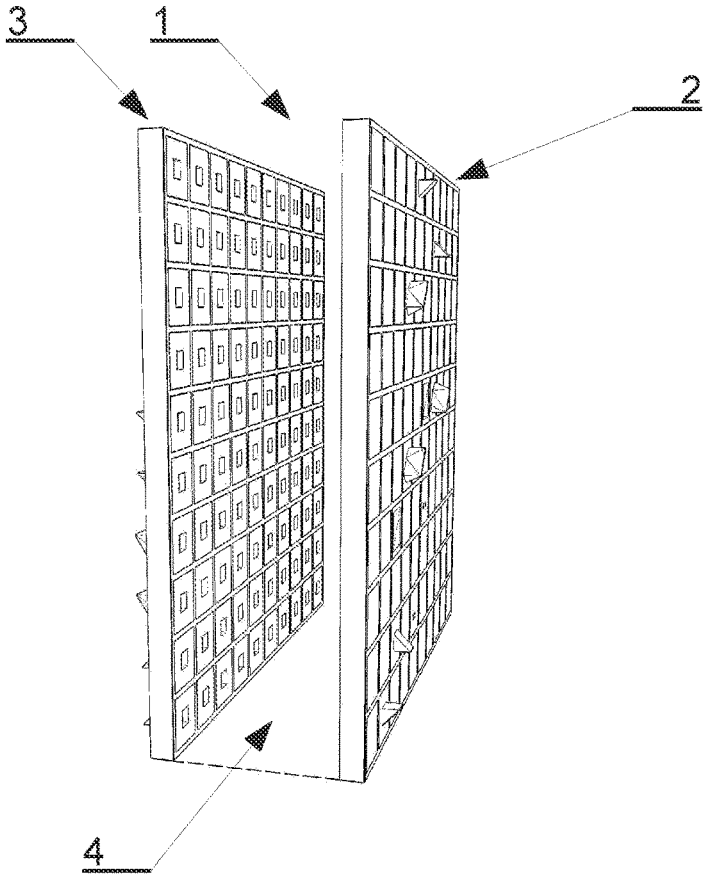
FIG. 1 is a perspective outline view of a climbing wall having a climbing wall module and a climbing holds storage module in accordance with the disclosure.
Figure 2:
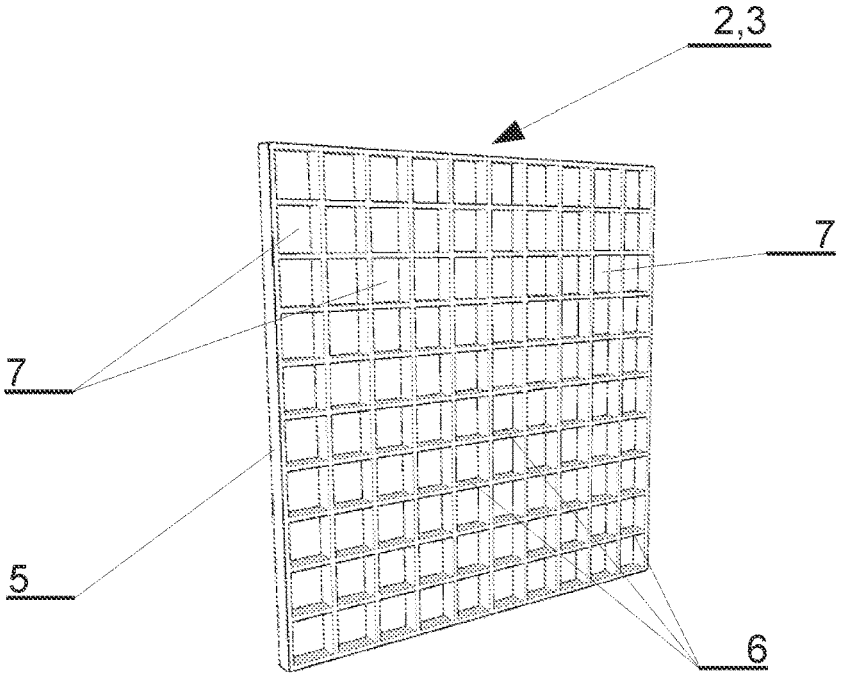
FIG. 2 is a perspective view of a supporting construction of the climbing wall module and the hold storage module.
Figure 3:
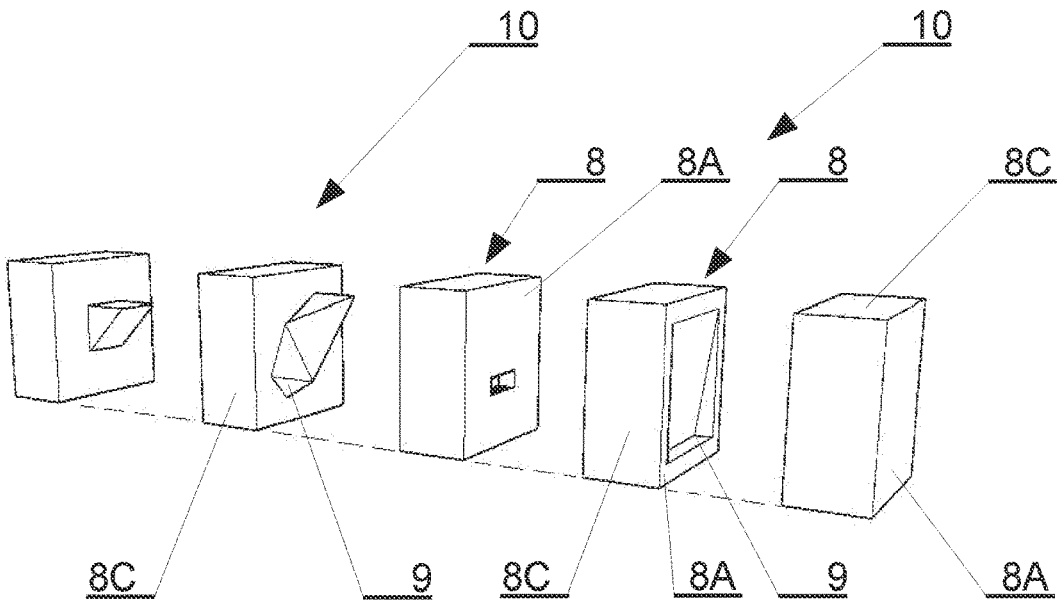
FIG. 3 is an outline view of exemplary climbing holds in accordance with the disclosure.
Figure 4:
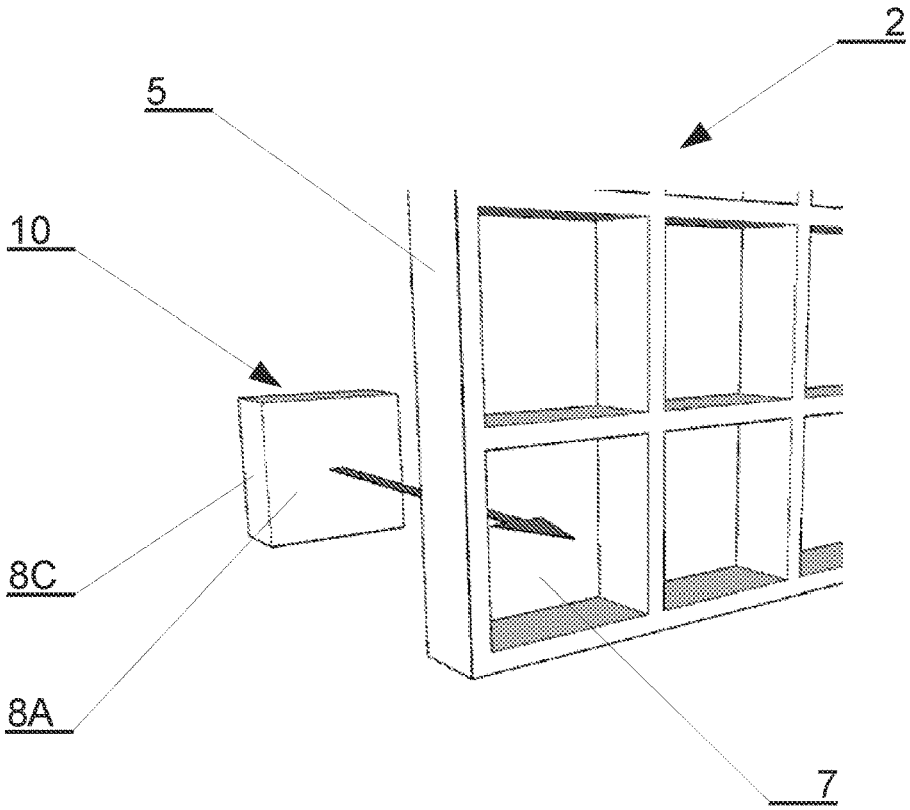
FIG. 4 is a partial outline view of a climbing wall module with a climbing hold in accordance with the disclosure.
Figure 5:
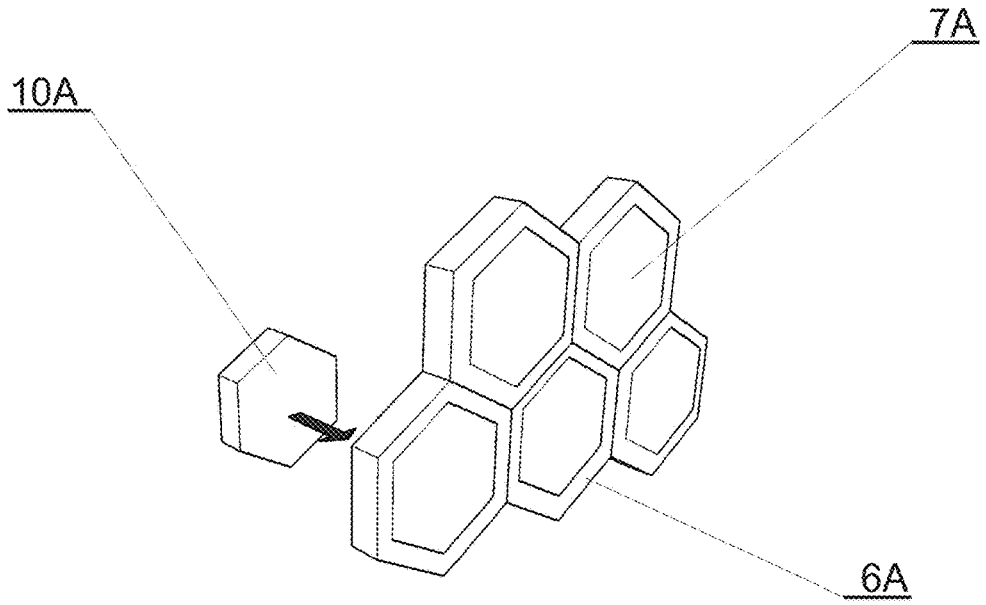
FIG. 5 is a partial outline view of an alternative embodiment of a climbing wall module with a climbing hold in accordance with the disclosure.
Figure 6:
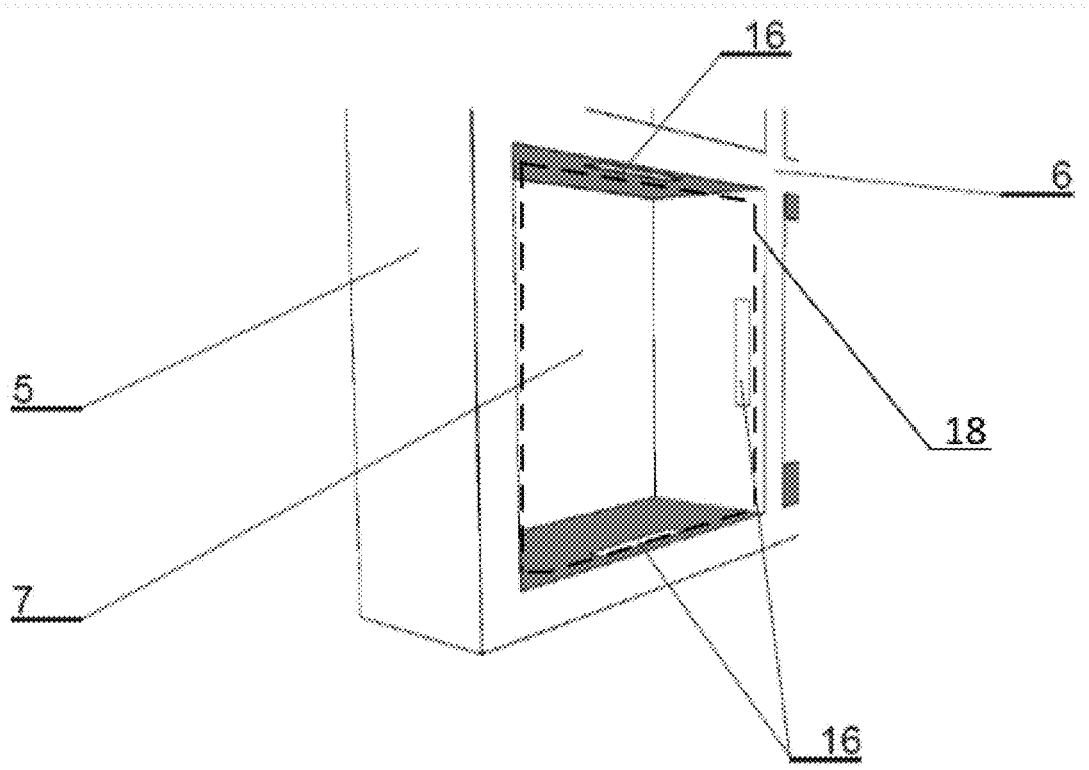
FIG. 6 is an enlarged detail view from an outline perspective of a supporting construction of the climbing wall module in accordance with the disclosure.
Figure 7:
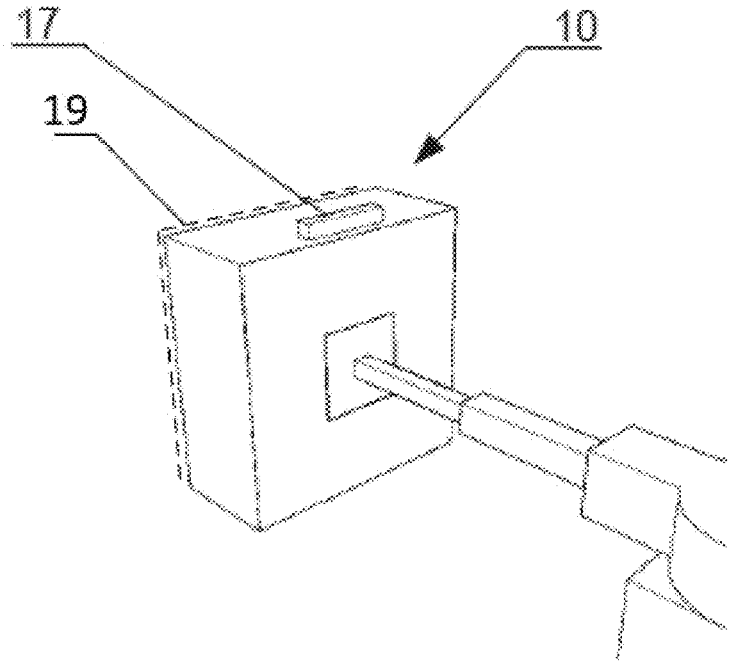
FIG. 7 is an outline view of a climbing hold from a rear perspective in accordance with the disclosure.
Figure 8:
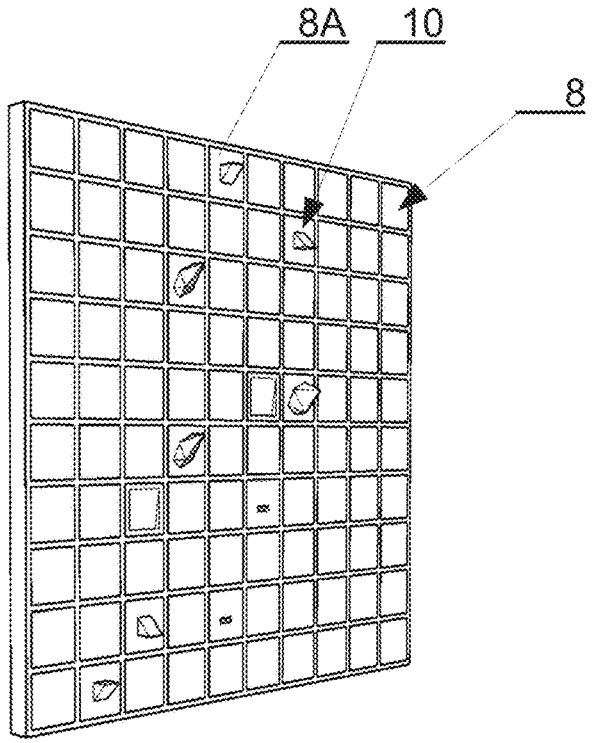
FIG. 8 is an outline view of a climbing wall having a climbing route arranged thereon in accordance with the disclosure.
Figure 9:
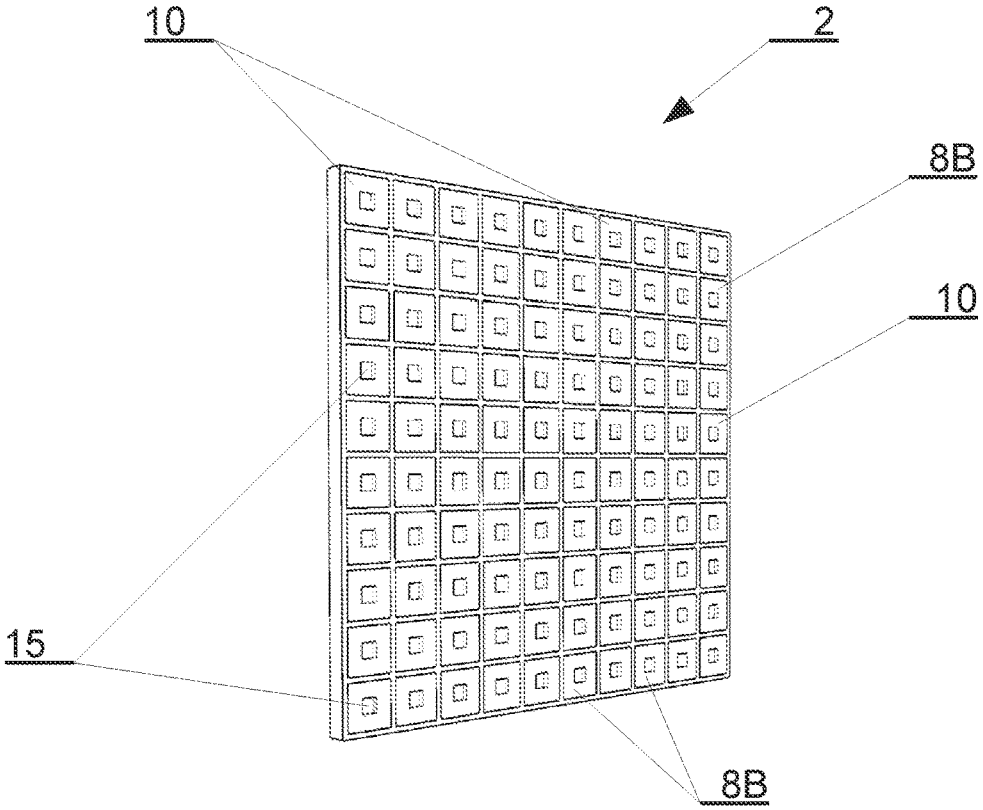
FIG. 9 is a rear perspective view of the climbing wall of FIG. 8.
Figure 10:
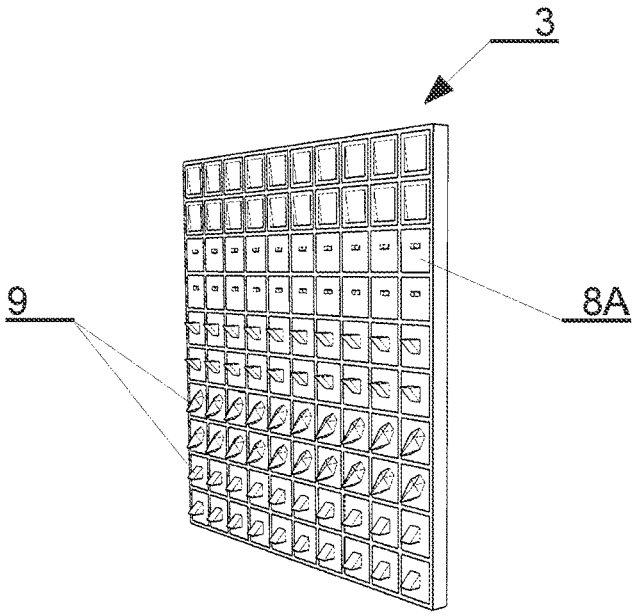
FIG. 10 is an outline view of a climbing holds storage module in accordance with the disclosure.
Figure 11:
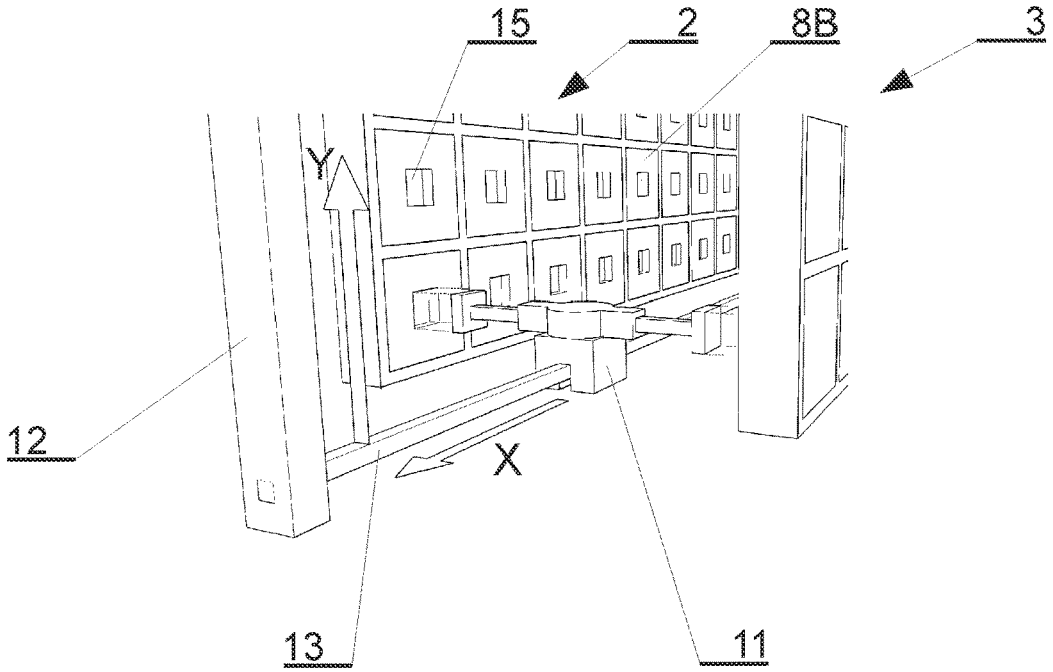
Figure 12:
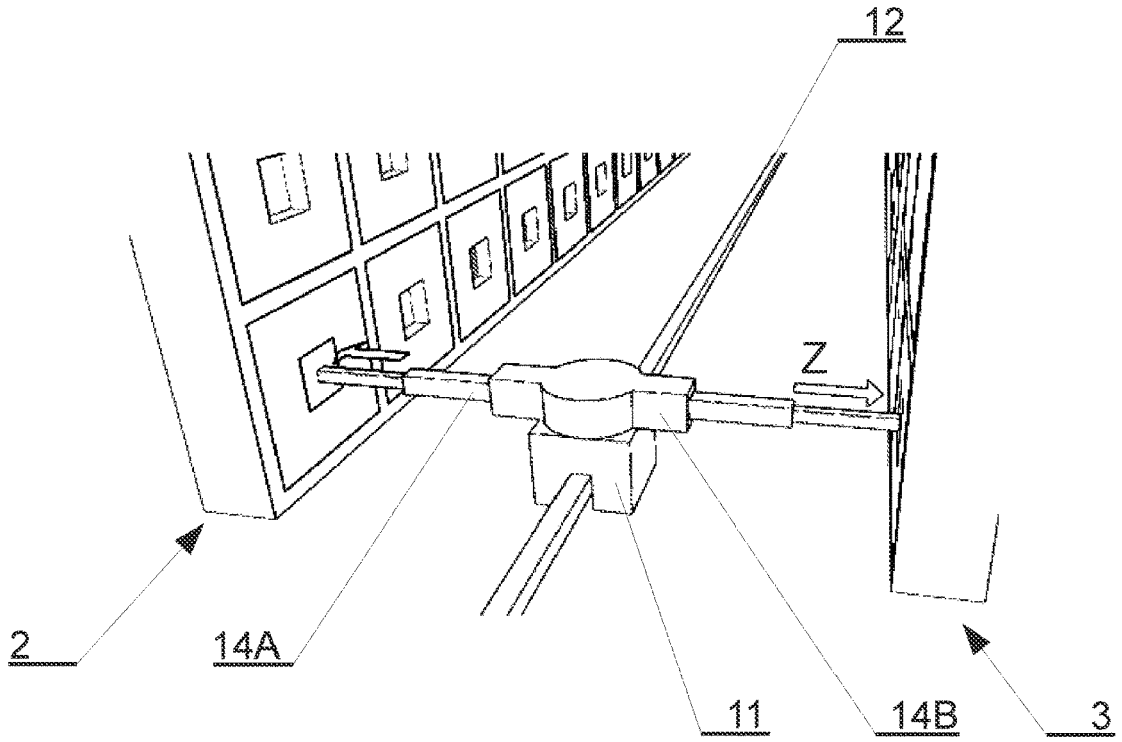
Figure 13:
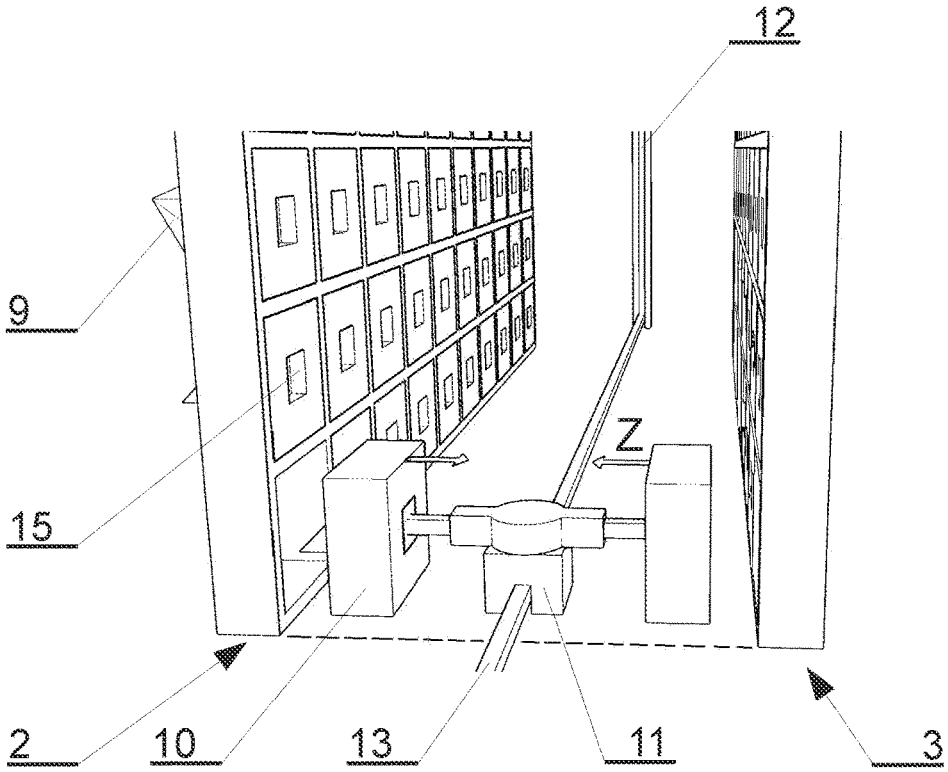
Figure 14:
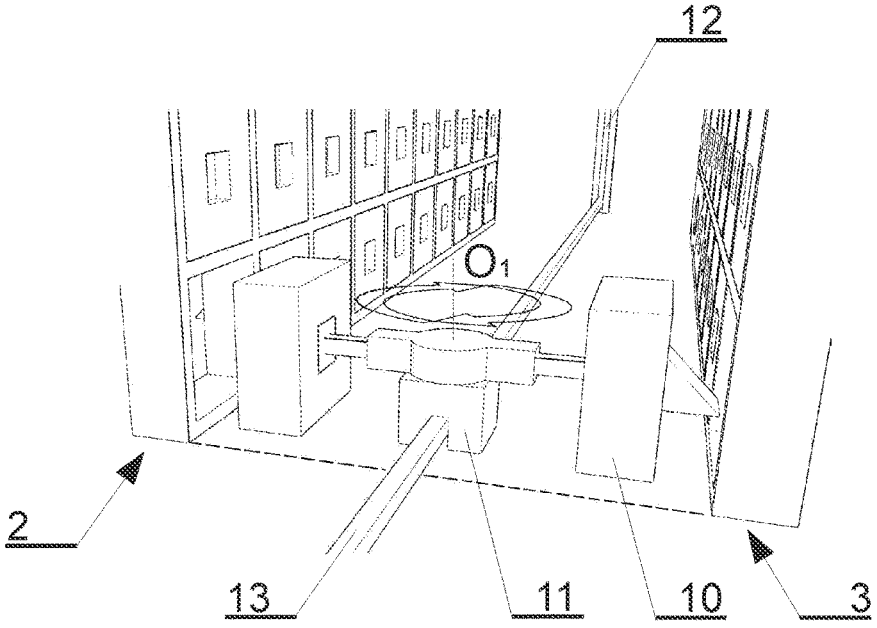

The present disclosure describes embodiments, in which FIG. 1 presents a climbing wall with a climbing wall module and a climbing holds storage module in a perspective view, with the working space between them, FIG. 2—the supporting construction of the climbing wall module and the hold storage module in a perspective view, FIG. 3—sample climbing holds in a perspective view, FIG. 4—a fragment of the climbing wall module with a climbing hold in a perspective view, FIG. 5—a fragment of the climbing wall module with a climbing hold in a perspective view in another embodiment, FIG. 6—a fragment of the supporting construction of the climbing wall module in a perspective view, FIG. 7—a climbing hold in a perspective view of the back wall, FIG. 8—the climbing wall module in a perspective view with a climbing route arranged, FIG. 9—the climbing wall module in a perspective view of the back working surface, FIG. 10—the climbing holds storage module in a perspective view of the back wall; FIGS. 11-15 present a Cartesian coordinate robot in the working space in perspective views, presenting the directions of movements of the robot, FIG. 16—combined climbing wall modules in two different configurations in a perspective view.

The climbing wall 1 (FIG. 1) comprises one climbing wall module 2 and one climbing holds storage module 3. Behind the climbing wall module 2, there is one climbing holds storage module 3 at a distance from it. As a consequence, between the climbing wall module 2 and the climbing holds storage module 3, there is a space, in the further part of the embodiments also described as the working space 4. The space between the climbing wall module 2 and hold storage module 3 is delimited primarily by the back surface of the climbing wall module 2 and the front surface of the climbing holds storage module 3. In other embodiments, the climbing wall 1 can comprise more than one climbing wall module 2 and/or more than one climbing holds storage module 3.

Both the climbing wall module 2 (FIG. 2) and the climbing holds storage module 3 have a supporting construction 5 with an arrangement of vertical and horizontal partitions 6 defining spatial compartments 7 in the shape of a cuboid. In the spatial compartments 7 (FIG. 4), the bodies 8 (FIG. 3) of climbing holds 10 with the shape of a cuboid are detachably mounted. In these bodies 8, one can distinguish a front 8A and a back wall 8B, as well as side walls 8C. The bodies 8 of the climbing holds 10 have proper climbing holds 9 on the front wall 8A. The body 8 of the climbing hold 10 with the proper climbing hold 9 forms the climbing hold 10. The proper climbing hold 9 can have any form, starting from ordinary cuboids protruding beyond the plane defined by the edges of the supporting construction 5, ending with any type of regular three-dimensional geometric figures or irregular forms imitating natural convex or concave rock faces, and serving the function of climbing holds and footrests commonly encountered on artificial climbing walls. The proper climbing hold 9 in a concave form is a depression entering the inside of the body 8 of the climbing hold 10. In the climbing wall 1, there are also neutral climbing holds 10, which have a flat front wall 8A. Upon mounting in the compartment 7 of the climbing wall module 2, the neutral climbing holds 10 along with the construction elements and other climbing holds 10 form a substantially even surface. The climbing holds 10 can be mounted arbitrarily in the compartments 7, since it is possible to rotate each body 8 of the climbing hold 10 by 90°, which changes the position of the proper climbing hold 9.

In the second embodiment (FIG. 5), the spatial compartments 7A have the shape of regular hexagons, with the climbing holds 10A assigned thereto. The body of the climbing hold 10A is a spatial block having in its both bases hexagons, which constitute the front and back wall, respectively. Within this body, one can also distinguish side walls. The hexagonal spatial compartments 7A are formed by proper arrangement of the partitions 6A. Such a shape of the spatial compartments 7A and the climbing holds provides more possibilities for setting up the proper climbing hold, since the climbing hold 10A can be rotated by 60° and set up in a proper position.

In other embodiments, the spatial compartments can have any shape defined by the arrangement of partitions in the supporting construction. In particular, the compartments can have the shape of regular polygons, having in their base figures such as a triangle, a pentagon or an octagon.

In the climbing wall module 2, one can distinguish a front surface adjusted to the movements of the users of the climbing wall, as well as a back working surface. The front surface of the climbing wall module 2 is formed by the supporting construction 5 of this module, along with the front walls 8A of the bodies 8 of the climbing holds 10. The proper climbing holds 9 forming the climbing routes are placed in the front surface (FIG. 8). The climbing routes are formed by various types of climbing holds 10 arranged in any configuration in the matrix of compartments 7 of the climbing wall module 2. The back walls 8B of the bodies 8 of the climbing holds 10 are placed in the back working surface of the climbing wall module 2 (FIG. 9). Therefore, the back walls 8B of the bodies 8 of the climbing holds 10 are accessible from the side of the working space 4. Also in the climbing holds storage module 3, the bodies 8 of the climbing holds 10 are arranged in such a manner that the back walls 8B of the bodies 8 of the climbing holds 10 are accessible from the side of the working space 4. For example, the climbing holds 10 are arranged in the compartments 7 (FIG. 10) of the hold storage module 3 in a grouped and ordered manner.

Moreover, safety points (not shown in the drawing) for transferring the required static and dynamic loads during the climbing and falling of the climbers, are mounted on the front surface in the supporting construction 5 of the climbing wall module 2. On the other hand, as already mentioned, behind the climbing wall module 2, the climbing holds storage module 3 is placed at a distance therefrom.

In the simplest design of the climbing wall 1, the space between the climbing wall module 2 and the climbing holds storage module 3, meaning the so-called working space 4, is adjusted solely to the movements of robot, especially Cartesian coordinate robot 11. Therefore, any robot moving in the working space 4 between the modules, can arbitrarily exchange the climbing holds 10 between the climbing wall module 2 and the climbing holds storage module 3. Moreover, the robot can also change only the angular position of the climbing holds 10, thus modifying the arrangement of the individual proper climbing holds 9 along the climbing route.

Therefore, any robot adjusted to manipulate the multi-walled bodies 8 of the climbing holds 10 placed in the climbing wall module 2 and in the climbing holds storage module 3 can be placed in the working space 4. In the embodiment presented in the drawing, a Cartesian coordinate robot 11 is placed centrally in the working space 4 (FIGS. 11-15), between the climbing wall module 2 and the climbing holds storage module 3. To this end, in the working space 4 there are two seated vertical guiding rails 12, on which a horizontal guiding rail 13 is slidingly mounted. The Cartesian coordinate robot 11 is also slidingly seated on the horizontal guiding rail 13. The Cartesian coordinate robot 11 has a body moving on the horizontal guiding rail 13, to which the joint base of two gripping and manipulating arms 14A, 14B is rotatably connected. Moreover, the gripping and manipulating arms 14A, 14B are themselves rotatably connected to the joint base. Therefore, the Cartesian coordinate robot 11 is capable of moving vertically in the Y direction, and thus along the height of the climbing wall 1, horizontally in the X direction, and thus along the width of the climbing wall 1, and via the rotational connection of the joint base of the two gripping and manipulating arms 14A it performs a rotational movement around the vertical axis O1, and it can exchange the climbing holds 10 between the climbing wall module 2 and the climbing holds storage module 3. Moreover, the rotatable connection of the gripping and manipulating arms 14A, 14B to the joint base via the rotational movement around the horizontal axis O2 translates to the possibilities of angular setting of the position of the climbing holds 10.

The gripping and manipulating arms 14A, 14B of the Cartesian coordinate robot 11 have a telescopic design, and they are ended with a square hand provided with an electromagnet. The telescopic design of the gripping and manipulating arms 14A, 14B allows for very easy extension or reduction of their length. Therefore, the gripping and manipulating arms 14A, 14B move in the Z direction, which allows for reaching the climbing holds 10 from the working space 4 with an extended position of the gripping and manipulating arms 14A, 14B, and it allows for manipulating the climbing holds 10 with a retracted position of the gripping and manipulating arms 14A, 14B. All these actions can be performed in the space between the climbing wall module 2 and the hold storage module 3.

Other embodiments are possible, in which a robot, and in particular a Cartesian coordinate robot, will have a larger number of gripping and manipulating arms, like for example four or six. A larger number of arms will result in speeding up the exchange of the climbing holds 10 between the climbing wall module 2 and the hold storage module 3.

The body 8 of the climbing hold 10 on the back wall 8B has a square depression forming a service hold 15, to which the hand of the gripping and manipulating arms 14A, 14B is adjusted in shape. Moreover, in the area of the back wall 8B of the body 8 of the climbing hold 10, there is an iron plate, which, upon activating the electromagnet of the gripping and manipulating arm 14A, 14B, allows for maintaining the climbing hold 10 connected to the gripping and manipulating arm 14A, 14B. Therefore, the service hold 15 allows the Cartesian coordinate robot 11 for any manipulations of the climbing hold 10, like grasping, rotating, as well as removing and seating in the compartments 7 of the climbing wall module 2 or the hold storage module 3.

The mounting of the climbing holds 10 in the compartments of the climbing wall module 2 and the climbing holds storage module 3 can be in turn implemented using various means. In an embodiment, there are recesses 16 in the partitions 6 of the supporting construction 5 of the climbing wall module 2 and the climbing holds storage module 3. In a single compartment 7, the recesses 16 are provided in each wall formed by the partition 6, and thus four recesses 16 are assigned to each compartment. The body 8 of the climbing hold 10 in turn has one movable protrusion 17 on one side wall. The recesses 16 are adjusted to receive the protrusion 17, after placing the body 8 of the climbing hold 10 in the compartment 7 of the climbing wall module 2 or the climbing holds storage module 3. The protrusion 17 enters the recess 16 in the partitions 6. The protrusion 17 is placed near the back wall of the body 8 of the climbing hold 10, and it is expanded by a spring placed inside the body 8 of the climbing hold 10. The protrusion 17 in its lower part has an iron element, which is engaged by the electromagnet of the gripping and manipulating arm 14A, 14B. The action of the electromagnet causes overcoming of the spring force, which as a further consequence makes the protrusion 17 hide inside the body 8 of the climbing hold 10, and it is possible to insert or remove the climbing hold 10 to or from a proper compartment 7. Therefore, in the basic position, the projection protrudes beyond the edge of the body 8 of the climbing hold 10, and upon placing in the climbing wall module 2 or in the climbing holds storage module, it enters the recess 16. This results in successful securing of the body 8 of the climbing hold 10 in the compartment 7, locking the body 8 of the climbing hold 10 in each direction of movement. The recesses 16 present on each wall of the compartment 7 allow for locking the body 8 of the climbing hold in any position.

The shape of the spatial compartments 7 of the supporting construction 5 of the climbing holds storage module 3 corresponds to the shape of the compartments 7 in the supporting construction 5 of the climbing wall module 2. This allows for using the same supporting constructions 5 in the climbing wall module 2 and in the climbing holds storage module 3. This also facilitates arranging the climbing holds 10, in particular using the Cartesian coordinate robot 11.

In other embodiments, the climbing wall module and the climbing holds storage module have different shapes of the compartments. In particular, the climbing holds storage module has relatively large compartments, so that even four climbing holds can be arranged in a single compartment, which however requires increased caution. The climbing wall module in turn has compartments adjusted to receive one body of the climbing hold.

In another embodiment, the climbing wall 1A (shown in FIG. 16A) and 1B (shown in FIG. 16B) has four climbing wall modules 2, the supporting constructions 5 of these climbing wall modules 2 being articulately connected to each other. This allows for changing the positions of the individual modules of the climbing wall 1A, 1B with respect to each other. In the climbing wall 1A, two climbing wall modules 2 have been arranged at an acute angle relative to the two remaining climbing wall modules 2, forming climbing routes with a bend, and in the wall 1B forming climbing routes in an overhang.

The Cartesian coordinate robot can also cooperate with the climbing wall 1A, 1B. To this end, the robot's arm is provided with an additional hinge, allowing for tilting of the hand corresponding to the inclination of the climbing wall 1A, 1B.

In still further embodiments, the front surface of the compartment of the supporting construction of the climbing wall module 2 has motion restrictors 18 (indicated in dashed lines for the body of the climbing hold, preventing the climbing holds from sliding out towards the user of the climbing wall. A particular form of such a motion restrictor 18 is providing a compartment 7 in the climbing wall module 2 with a smaller clearance on the front surface of the wall module compared to the back surface of the wall module. As a consequence, the body of the climbing hold is locked and it cannot be removed from the front side of the climbing wall. Moreover, the back wall of the body of the climbing hold 10 also has a locking flange 19 (indicated in dashed lines), overlapping the partitions and also securing the climbing hold against sliding out.

As mentioned above, the climbing routes are formed by various types of climbing holds 10 arranged in any configuration in the matrix of compartments 7 in the climbing wall module 2. The arrangement of climbing routes on the climbing wall 1, 1A, 1B involves seating the selected bodies 8 of the climbing holds 10 with a proper respective climbing hold 9 in selected compartments 7 of the climbing wall module 2. It can be assumed that the climbing wall 1 is in a neutral state when all compartments 7 are filled with neutral climbing holds 10, and thus when the climbing wall 1 has a flat front surface. The climbing holds 10 can be replaced by robot, which is moving in the working space 4. The actions which must be performed by the Cartesian coordinate robot 11 arranging a climbing route on the climbing wall 1, 1A, 1B can be presented in more detail. The Cartesian coordinate robot 11 consecutively aligns itself with a selected compartment 7 of the climbing wall module 2 using predetermined coordinates in a two-dimensional working space 4, and subsequently the gripping and manipulating arm 14A grasps the body 8 of the climbing hold 10, which results in its unlocking. In the subsequent steps, the Cartesian coordinate robot 11 aligns itself with a selected compartment 7 of the climbing holds storage module 3 and it grasps the body 8 of the climbing hold 10 from the compartment 7 of the hold storage module 3 using the second gripping and manipulating arm 14B. This step is followed by the rotational movement of the gripping and manipulating arms 14A, 14B and a change in the position of these arms. The body 8 of the climbing hold 10 is stored in the compartment 7 of the hold storage module 3 using the gripping and manipulating arm 14A. After this step, the Cartesian coordinate robot returns to the previous compartment 7 of the climbing wall module 2, and, using the gripping and manipulating arm 14B, it stores the body 8 of the climbing hold 10 taken from the climbing holds storage module 3 therein.

The Cartesian coordinate robot 11 is controlled remotely, and it can also be connected to the Internet. As a consequence, the arrangement of climbing routes can be realized by controlling the Cartesian coordinate robot 11 from a control panel placed within the climbing wall 1, or by other types of applications and internet applications, in particular mobile applications. This also increases the functionality of the Cartesian coordinate robot, since the climbing routes can be arranged according to designs provided in a database, or the users' own designs.

It is preferable when the shape of the spatial compartments of the climbing holds storage module corresponds to the shape of the compartments of the climbing wall module.

It is purposeful when, on the back wall of the body of the climbing hold, there is at least one service hold for manipulating the climbing hold.

It is reasonable when, in the space between the climbing wall module and the climbing holds storage module, there is a multiaxial Cartesian coordinate robot having at least one gripping and manipulating arm.

It is good when the Cartesian coordinate robot has a telescopic gripping and manipulating arm.

It is particularly preferable when the gripping and manipulating arm is mounted rotatably in a vertical axis and/or a horizontal axis.

It is purposeful when the gripping and manipulating arm has at least one articulation.

It is equally purposeful when the gripping and manipulating arm has an electromagnet.

It is equally preferable when, in at least one wall of each of the compartments, there is at least one recess adjusted to receive at least one movable protrusion placed on at least one side wall of the body of the climbing hold.

It is good when the front surface of the climbing wall module has motion restrictors for the body of the climbing hold.

It is also desirable when the compartment of the climbing wall module is configured such that the opening on the front surface of the wall module has a smaller clearance compared to the opening in the back surface of the climbing wall module, so that the body of the climbing hold received in the compartment is locked and it cannot be removed from the front side of the climbing wall.

It is equally purposeful when the back wall of the body of the climbing hold has a locking flange.

It is reasonable when safety points, which for securing users of the climbing wall during climbing and falling, are mounted in the supporting construction of the climbing wall module.

It is purposeful when the climbing holds storage module is arranged parallel to the climbing wall module.

The primary advantage of the embodiments in accordance with the disclosure is providing storage room for various types of climbing holds in direct proximity to the climbing wall itself, which has been achieved due to a storage module for climbing holds. This is accompanied by retaining the simple design of the bodies of the climbing holds, which are seated in the compartments of the climbing wall module, as well as of the climbing holds storage module. The body of a climbing hold is slid into the compartments of the climbing wall module or the climbing holds storage module. The climbing wall modules have a front surface adjusted to the movements of the users of the climbing wall thereon. By placing the climbing holds storage module away from the climbing wall module, a space has been provided between the climbing wall module and the climbing holds storage module, in which the exchange of holds is realized. The exchange and arrangement of climbing routes is realized by a robot placed in this space and adjusted to manipulate the bodies of the climbing holds. The exchange of the body of a climbing hold proceeds very quickly by moving the body of the climbing hold from the climbing wall module to the climbing holds storage module. Moreover, when a robot is used, it is possible to exchange the climbing holds without the participation of workers. The use of the robot enables the achievement of further advantages. It is possible to control the robot remotely, or to arrange climbing routes in dedicated software and transmit a set of instructions for autonomous performance by the robot. Moreover, the robot can perform its activities during the climbing of climbers on the climbing wall, or during a time when the climbing wall is not used, for example at night hours. Therefore, climbing routes can be arranged automatically, since the robot automatically places arbitrarily selected holds from the climbing holds storage module in the climbing wall module.

Further advantages are achieved by forming spatial compartments corresponding to the compartments in the supporting construction of the climbing wall. Due to this, in the working space it is possible to use a Cartesian coordinate robot, whose design is simple and works in three-dimensional spaces, allowing for the performance of movements in all directions. Providing the robot with an arm with a telescopic design allows for easy reaching of the climbing holds from the working space with the arm extended, and with the arm retracted, it enables manipulating these climbing holds in a limited space. The easiness of manipulation is also influenced by the rotational mounting of the gripping and manipulating arm in a horizontal and vertical axis. Providing a service hold on the back surface of the body of the climbing hold in turns allows for easy grasping of this body of the climbing hold both by a properly adjusted robot. This increases the secureness of holding the climbing hold, and reduces the risk of unintentional releasing of the climbing hold. Providing the robot's arm with an electromagnet allows for its simple cooperation with various kinds of metal elements, with which the body of the climbing hold can be provided.

Still other advantages are achieved when, in at least one wall of each of the compartments, there is at least one recess adjusted to receive at least one movable protrusion placed on at least one side wall of the body of the hold. This enables simple locking of the body of the climbing hold in the compartment. The mounting of the bodies of the climbing holds in the compartments of the modules of the climbing wall or of the hold storage can also be realized in the front surface of the climbing wall module, in particular when the front surface of the climbing wall module has motion restrictors for the body of the climbing hold, or the compartment of the supporting wall module has a smaller clearance on the front surface of the wall module than on the back surface of the wall module. Moreover, providing the body of the climbing hold with a locking flange on the back wall also protects the climbing hold against being removed by a user of the climbing wall.

The supporting construction of the climbing wall module is adjusted to transfer huge loads, and thus safety points for transferring the required static and dynamic loads during climbing and falling of the climbers can be mounted therein. Yet another advantage can be achieved by an articulated connection of the supporting constructions of the modules of the climbing wall or the climbing holds storage. This allows for the construction of slabs or overhangs, as well as bends or edges. A robot can also cooperate with the climbing wall modules arranged in such a manner, one which can have another articulated connection in its arm, allowing for tilting of the arm according to the inclination of the climbing wall module.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A climbing wall, comprising:

a climbing wall module having a supporting construction with an arrangement of partitions defining spatial compartments with a plurality of bodies of climbing holds placed therein, wherein each of the spatial compartments includes at least a front wall;

wherein the front wall and the plurality of bodies of the climbing holds along with the supporting construction associated with the front wall define a front surface of the climbing wall module;

a climbing holds module associated with the climbing wall module and disposed at a distance therefrom, the climbing holds module including an additional supporting construction having an arrangement of partitions defining spatial compartments adjusted to receive the plurality of bodies of the climbing holds therein; and at least one robot disposed in a space between the climbing wall module and the climbing holds module, the at least one robot configured to manipulate the plurality of bodies of the climbing holds by selectively transferring them between the spatial compartments in the climbing wall module and in the climbing holds module.

2. The climbing wall of claim 1, wherein the at least one robot operates to selectively create an adjustable front surface by arranging different ones of the plurality of bodies of the climbing holds in the spatial compartments of the climbing wall module.

3. The climbing wall of claim 1, wherein each of the spatial compartments of each of the climbing wall module and the climbing holds module further includes at least a back wall and side walls.

4. The climbing wall according to claim 1, wherein the spatial compartments of the climbing holds module corresponds to a shape of the spatial compartments of the climbing wall module.

5. The climbing wall according to claim 1, wherein a back wall of each of the plurality of bodies of the climbing holds forms at least one service hold that is engageable by the at least one robot for placement and removal from a respective spatial compartment.

6. The climbing wall according to claim 1, wherein the at least one robot is a multiaxial Cartesian coordinate robot having a gripping and manipulating arm.

7. The climbing wall according to claim 6, wherein the gripping and manipulating arm is a telescopic gripping and manipulating arm.

8. The climbing wall according to claim 6, wherein the gripping and manipulating arm is rotatably disposed with respect to a vertical axis and/or a horizontal axis.

9. The climbing wall according to claim 6, wherein in that the gripping and manipulating arm has at least one articulation.

10. The climbing wall according to claim 6, wherein the gripping and manipulating arm includes an electromagnet for engaging and disengaging the plurality of bodies of the climbing holds.

11. The climbing wall according to claim 1, wherein the front wall of each of the spatial compartments includes at least one recess, wherein each of the plurality of bodies of the climbing holds includes at least one moveable protrusion, and wherein the at least one moveable protrusion is configured to matingly and releasably engage the front wall when a respective climbing hold body is disposed within a respective spatial compartment.

12. The climbing wall according to claim 1, wherein the front surface of the climbing wall module further includes motion restrictors that engage the plurality of bodies of the climbing holds.

13. The climbing wall according to claim 1, wherein a back wall of each of the plurality of the bodies of climbing holds includes a locking flange.

14. The climbing wall according to claim 1, wherein each of the climbing wall module and the climbing holds module has a generally flat shape, and wherein the climbing wall module and the climbing holds module are arranged parallel to one another.

15. The climbing wall according to claim 1, further comprising a second climbing wall module that is pivotally associated with and arranged to selectively incline relative to the climbing wall module.

16. The climbing wall according to claim 15, wherein the second climbing wall module further comprises a plurality of spatial compartments.

17. The climbing wall according to claim 16, wherein each of the plurality of spatial compartments in the climbing wall module has a rectangular shape.

18. The climbing wall according to claim 16, wherein each of the plurality of spatial compartments in the climbing wall module has a non-rectangular shape.

* * * * *